US008210135B2

(12) United States Patent
Slaughter et al.

(10) Patent No.: US 8,210,135 B2
(45) Date of Patent: Jul. 3, 2012

(54) CRANKCASE VENTILATION SYSTEM

(75) Inventors: Seth Evan Slaughter, Peoria, IL (US); James Richard Weber, Lacon, IL (US); James Carl Durand, Dunlap, IL (US); Richard Francis Norton, Brimfield, IL (US); Mark Andrew McElroy, Peoria, IL (US); Mark Taylor Allott, Mapleton, IL (US); Joseph John Stabnik, Peoria, IL (US); Nilkanth Dinesh Desai, Peoria, IL (US); Seth Carl Studnicka, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 745 days.

(21) Appl. No.: 12/232,969

(22) Filed: Sep. 26, 2008

(65) Prior Publication Data

US 2009/0199794 A1 Aug. 13, 2009

Related U.S. Application Data

(60) Provisional application No. 61/064,001, filed on Feb. 8, 2008.

(51) Int. Cl.
*F01M 13/00* (2006.01)
*F02B 25/06* (2006.01)

(52) U.S. Cl. ..... 123/41.86; 123/572

(58) Field of Classification Search ..... 123/41.86, 123/572–574

See application file for complete search history.

(56) References Cited

U.S. PATENT DOCUMENTS

| | | | | |
|---|---|---|---|---|
| 1,944,341 | A * | 1/1934 | Geise | 123/41.86 |
| 2,642,052 | A * | 6/1953 | Wagner et al. | 123/573 |
| 2,652,819 | A | 9/1953 | Nusbaum | |
| 3,246,639 | A * | 4/1966 | Oliver | 123/572 |
| 3,362,386 | A * | 1/1968 | McMahon | 123/573 |
| 3,665,906 | A * | 5/1972 | De Palma | 123/519 |
| 4,089,309 | A | 5/1978 | Bush | |
| 4,269,607 | A * | 5/1981 | Walker | 95/271 |
| 4,401,093 | A | 8/1983 | Gates, Jr. et al. | |
| 4,409,950 | A | 10/1983 | Goldberg | |
| 4,453,525 | A | 6/1984 | DeBruler | |
| 5,450,835 | A | 9/1995 | Wagner | |
| 5,878,731 | A * | 3/1999 | Bedkowski | 123/573 |
| 5,937,837 | A | 8/1999 | Shaffer et al. | |
| 6,129,058 | A | 10/2000 | Muth | |
| 6,234,154 | B1 | 5/2001 | Spix | |
| 6,412,479 | B1 | 7/2002 | Canfield et al. | |

(Continued)

FOREIGN PATENT DOCUMENTS

EP 155442 A2 * 9/1985

*Primary Examiner* — Noah Kamen

(74) *Attorney, Agent, or Firm* — Finnegan, Henderson, Farabow, Garrett & Dunner LLP

(57) ABSTRACT

A ventilation system for use with an internal combustion engine having a crankcase is disclosed. The ventilation system may have a breather housing connected to ventilate gases from the crankcase, and a filtration canister fluidly connected downstream of the breather housing. The filtration canister may have a filter housing, a filtering medium located within the filter housing to collect oil from the gases, and an oil collection container disposed within the filter housing and being configured to receive at least a portion of the filtering medium. The oil collection container may have a drain port in fluid communication with the crankcase. The filtration canister may also have at least one port configured to discharge the gases from the housing after the gases have passed through the filtering medium.

19 Claims, 1 Drawing Sheet

U.S. PATENT DOCUMENTS

| | | | |
|---|---|---|---|
| 6,418,917 | B1 | 7/2002 | Bistue |
| 6,601,572 | B2 | 8/2003 | Okamoto |
| 6,772,744 | B2 | 8/2004 | Nanno et al. |
| 6,782,878 | B2 | 8/2004 | Spix |
| 6,860,010 | B2 | 3/2005 | Jones et al. |
| 2006/0226155 | A1 | 10/2006 | Roche et al. |
| 2009/0071111 | A1 | 3/2009 | Lundgren et al. |

* cited by examiner

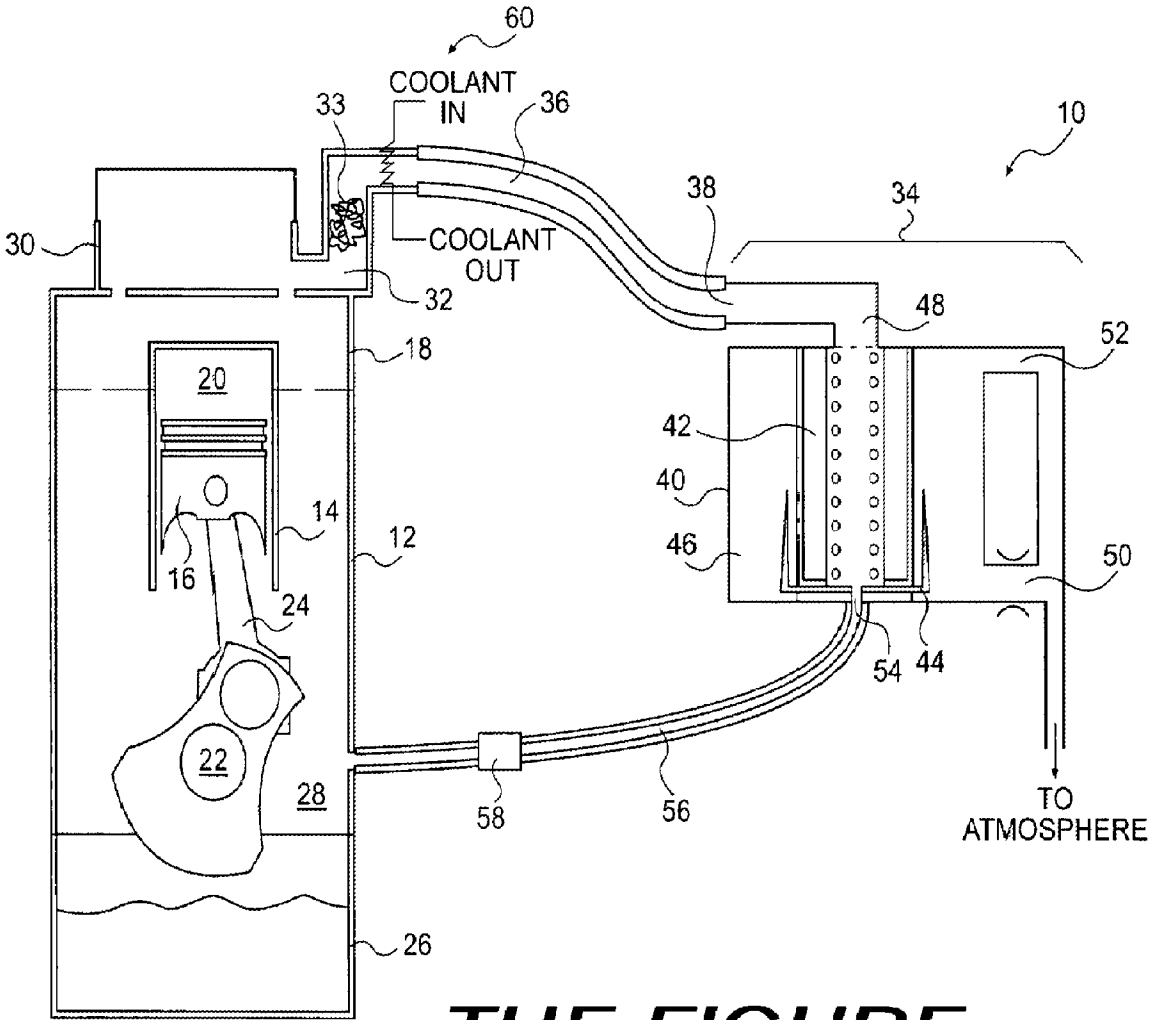
THE FIGURE

CRANKCASE VENTILATION SYSTEM

This application is based on and claims the benefit of priority from U.S. Provisional Application No. 61/064,001, filed Feb. 8, 2008.

TECHNICAL FIELD

The present disclosure relates generally to a ventilation system and, more particularly, to a ventilation system associated with a crankcase of an internal combustion engine.

BACKGROUND

An internal combustion engine typically includes an engine block that at least partially defines one or more cylinders. A piston is reciprocatingly disposed within each cylinder and, together with a cylinder head, forms a combustion chamber. A mixture of fuel and air is introduced into the combustion chamber and is compressed by the piston in preparation for combustion. When combustion takes place, the expanding gases force the piston downward to rotate a connected crankshaft, thereby converting chemical energy into kinetic energy. During an ensuing exhaust stroke of the piston, byproducts of the combustion event are displaced from the combustion chamber to the atmosphere.

Although effective, many losses may be associated with the combustion process described. One such loss is due to a necessary clearance between an outer surface of the piston and an inner surface of the associated cylinder. During a compression stroke of the piston and during combustion, some of the compressed and expanding gases leak through this clearance into the space below (i.e., into the crankcase). This leakage of gases is commonly known as "blow-by". During operation of the engine, the blow-by gases build within the crankcase, resulting in a high pressure region that acts against movement of the piston and reduces engine efficiency. To relieve this pressure and improve engine efficiency, a crankcase ventilation system is usually implemented.

One such crankcase ventilation system is disclosed in U.S. Pat. No. 5,450,835 (the '835 patent), issued to Wagner on Sep. 19, 1995. The '835 patent discloses an oil separator for reducing oil carryover from the vent port of the crankcase of a diesel engine. The separator includes a cylindrical housing filled with a filtration material, and having both an inlet and an outlet in its upper portion and a downwardly disposed frustro-conical wall that defines an annular chamber between its outer surface and the inner walls of the housing. The annular chamber defines a helical flow path through the filtration material in the housing for a stream of oil laden air admitted through the inlet of the housing. Oil droplets are removed from the stream of air as it moves through the helical path both by impingement against the filtration material, and then by centrifugal impingement against the inner walls of the housing. At the end of the helical path, the stream of air is directed along a hairpin turn through an opening in the frustro-conical wall and from thence into a double-back path before exiting the housing, thereby removing still more entrained oil droplets. The resulting filtered stream of air may be directed into the engine draft tube or the air filter by means of a pipe. The separator also includes an oil drain conduit for conducting liquid oil collected by the filtration material into the oil pan of the engine.

Although perhaps somewhat effective at venting a crankcase, the system of the '835 patent may have problems with water condensation. That is, water, which may be entrained within the air from the crankcase, may condense on the cooler walls of the separator and associated passages. And, because of the location of the oil drain conduit, the condensed water may drain back to the oil pan of the engine, where it may mix with and contaminate the oil therein.

The disclosed ventilation system is directed to overcoming one or more of the problems set forth above.

SUMMARY

In one aspect, the present disclosure is directed to a ventilation system for use with an engine having a crankcase. The ventilation system may include a breather housing connected to ventilate gases from the crankcase, and a filtration canister fluidly connected downstream of the breather housing. The filtration canister may include a filter housing, a filtering medium located within the filter housing to collect oil from the gases, and an oil collection container disposed within the filter housing and configured to receive at least a portion of the filtering medium. The oil collection container may include a drain port in fluid communication with the crankcase. The filtration canister may also include at least one port configured to discharge the gases from the housing after the gases have passed through the filtering medium.

In another aspect, the present disclosure is directed to a method of venting gases from an engine's crankcase. The method may include directing the gases from the crankcase to a filtering location, and inhibiting water vapor within the gases from condensing before the gases reach the filtering location. The method may further include removing oil from the gases at the filtering location, and directing the removed oil back into the crankcase. The method may also include discharging water that condenses at the filtering location to the atmosphere.

BRIEF DESCRIPTION OF THE DRAWING

FIG. 1 is a diagrammatic illustration of an exemplary disclosed power system.

DETAILED DESCRIPTION

FIG. 1 illustrates an exemplary power system 10. For the purposes of this disclosure, power system 10 is depicted and described as a four-stroke diesel engine. One skilled in the art will recognize, however, that power system 10 may be any other type of internal combustion engine such as, for example, a gasoline or a gaseous fuel-powered engine. Power system 10 may include an engine block 12 that at least partially defines one or more cylinders 14 (only one shown in FIG. 1), a piston 16 slidably disposed within each cylinder 14, and a cylinder head 18 that connects to engine block 12 to cap off an end of cylinder 14. Cylinder 14, piston 16, and cylinder head 18 may together form a combustion chamber 20. Power system 10 may include any number of combustion chambers 20, and combustion chambers 20 may be disposed in an "in-line" configuration, a "V" configuration, or in any other suitable configuration.

Power system 10 may also include a crankshaft 22 that is rotatably disposed within engine block 12. A connecting rod 24 may connect each piston 16 to crankshaft 22 so that a sliding motion of piston 16 between a top-dead-center position and a bottom-dead-center position within each respective cylinder 14 results in a rotation of crankshaft 22. Similarly, a rotation of crankshaft 22 may result in a sliding motion of piston 16 between the top-dead-center and bottom-dead-center positions. In a four-stroke diesel engine, piston 16 may reciprocate between the top-dead-center and bottom-dead-center positions through an intake stroke, a compression stroke, a combustion or power stroke, and an exhaust stroke.

An oil pan 26 may be connected to engine block 12 to form a cavity known as a crankcase 28 located below combustion chambers 20. Lubricant, for example engine oil, may be provided from oil pan 26 to engine surfaces to minimize metal-on-metal contact and thereby inhibit damage to the surfaces. Oil pan 26 may serve as a sump for collecting and supplying this lubricant.

Engine valves (not shown), for example exhaust and intake valves may be associated with the flow of gases into and out of combustion chamber 20, and be timed to move in relation to the movement of piston 16. For example, as crankshaft 22 rotates piston 16 through the intake stroke, the intake valve may open to allow air or an air and fuel mixture to be drawn or forced into combustion chamber 20. During the compression and power strokes, both the intake and exhaust valves may be closed to minimize leakage of gases from combustion chamber 20. During the exhaust stroke, the exhaust valve may open to allow byproducts of combustion to be pushed from combustion chamber 20. A cover 30 may be connected to cylinder head 18 and configured to house the engine valves.

In one embodiment, cover 30 may be vented. That is, cover 30 may include an outlet 32 in communication with crankcase 28 via openings in cylinder head 18 and engine block 12. In this way, blow-by gases may be relieved from crankcase 28 by way of cover 30 and outlet 32. This vented cover arrangement may be commonly known as a breather cover or a breather housing. In some embodiment, a filtering element 33 may be located within outlet 32 to prevent oil from splashing out of cover 30. It is contemplated that a breather housing separate from cover 30 (i.e., not associated with engine valves) may be utilized to vent crankcase 28, if desired. For the purposes of this disclosure, blow-by may be considered the byproducts of the combustion process that leak from combustion chamber 20 into crankcase 28 during engine operation.

In another embodiment, cover 30 may be thermally insulated. That is, in order to inhibit condensation of water vapor entrained in the blow-by gases, cover 30 may be insulated from the environment to minimize heat loss. In one example, cover 30 may be fabricated from a glass filed nylon material such that the water vapor is maintained at a temperature above its dew point.

The venting of blow-by gases to the atmosphere may be regulated to minimize the discharge of pollutants. To comply with these regulations, a filtration canister 34 may be connected downstream of cover 30 to condition the gases. A passageway 36 may connect outlet 32 of cover 30 to an inlet 38 of filtration canister 34. Filtration canister 34 may include a housing 40, a filtering medium 42 located within housing 40, and a collection container 44 located within housing 40 and configured to receive at least a portion of filtering medium 42.

Housing 40 may be fabricated from a thermally insulating material and include a central chamber 46, an inlet 48, a condensate discharge port 50, and a gaseous discharge port 52. In one example, housing 40 may be fabricated from the same insulating material as cover 30, such that the water vapor entrained within the blow-by gases may be inhibited from condensing before it passes through filtering medium 42. Inlet 48 may direct the blow-by gases into a center portion of filtering medium 42, which may be located within central chamber 46. By directing the blow-by gases into the center portion of filtering medium 42, expansion of the blow-by gases may be minimized, thereby reducing the likelihood of the water vapor condensing before it has passed through filtering medium 42. After passing through filtering medium 42, any water that has condensed on the interior walls of central chamber 46 may pass through condensate discharge port 50, while the remaining blow-by gases may pass from housing 40 to the atmosphere by way of gaseous discharge port 52. Discharge port 50 may be located gravitationally lower than gaseous discharge port 52 for discharge of the heavier condensate that collects in the bottom of the housing 40. It is contemplated that only a single discharge port may be included within housing 40, if desired. It is also contemplated that condensate discharge port 50 may be restricted, if desired, to limit a rate of liquid discharge from filtration canister 34. It is further contemplated that one or both of discharge ports 50, 52 may alternatively vent to an inlet of power system 10 (i.e., inlet manifold, inlet air filter, compressor, etc.), if desired, rather than to the atmosphere.

Filtering medium 42 may be a cartridge type medium having generally cylindrically shaped mesh material, bound on opposing axial ends by sealing mechanisms. The sealing mechanisms may be configured to press against an interior surface of housing 40 when filtration canister 34 is fully assembled. In one embodiment, filtering medium 42 may be pleated, and fabricated from a natural or synthetic material. Filtering medium 42 may be configured to block or trap liquid and vaporized oil, while allowing exhaust gases, liquid water, and water vapor to pass into central chamber 46.

Collection container 44 may be an open ended structure configured to receive at least a portion of filtering medium 42. In one embodiment, collection container 44 may be generally cup-like, having an inner diameter larger than an outer diameter of filtering medium 42 such that a clearance space is maintained therebetween. As the blow-by gases pass through filtering medium 42, liquid and vaporized oil may be trapped by the mesh material and then be pulled by gravity downward into collection container 44. A drain port 54 may be located within collection container 44 to allow the collected oil to drain back to crankcase 28 by way of a drain passage 56. A check valve 58 may be located within drain passage 56 to inhibit oil from crankcase 28 from flowing to filtration canister 34. In one embodiment, a floor portion of collection container 44 may be angled toward drain port 54 to facilitate draining of the collected oil. In another embodiment, an outer annular surface of collection container 44 may be angled to promote draining of any water that has condensed thereon toward the inner walls of housing 40 and condensate discharge port 50. In yet another embodiment, collection container 44 may be integral with housing 40, if desired.

In some situations, the insulation of cover 30, filtration canister 34, and passageway 36 may be insufficient to inhibit undesired condensation (i.e., to inhibit water condensation upstream of filtering medium 42). In these situations, a heating mechanism 60 may be located to heat the blow-by gases. In one example, heating mechanism 60 may be a liquid-to-air type heat exchanger that transfers heat from the engine's coolant to the blow-by gases. Other examples of heating mechanism 60 may include a fuel-fired burner, an electrical grid, a catalyst coated substrate, or other mechanism known in the art. It is contemplated that instead of or in addition to heating mechanism 60 being placed within the flow path of the blow-by gases, another heating mechanism (not shown) may be placed around passageway 36 to heat the blow-by gases as they pass from cover 30 into filtration canister 34, if desired.

INDUSTRIAL APPLICABILITY

The disclosed ventilation system may applicable to any combustion engine where the atmospheric discharge of blow-by gases is regulated, and where a lubricating oil quality is important. The disclosed ventilation system may minimize the amount of oil passed to the atmosphere, while simultaneously reducing the amount of water that is allowed to mix with and contaminate oil within the engine. The operation of power system 10 will now be discussed.

During operation of power system 10, air or an air and fuel mixture may be drawn into combustion chamber 20 during the downward intake stroke of piston 16. As piston 16 moves upward during the compression stroke, the mixture may be ignited, and the resulting expanding gases may force piston 16 downward again during the power stroke. Because of a clearance space between piston 16 and the interior walls of cylinder 14, some of the compressed and expanding gases may leak into crankcase 28. If unaccounted for, these leaking gases could build within crankcase 28 and negatively affect performance of power system 10.

In order to relieve the pressure within crankcase 28, the blow-by gases may be vented upward through open spaces within engine block 12, to cover 30. From cover 30, the gases may pass through filtering element 33, past heating mechanism 60, and into filtration canister 34. Within filtration canister 34, the blow-by gases may pass through filtering medium 42, where any liquid or vaporized oil may be trapped. The trapped oil may drain back into crankcase 28 by way of drain port 54 and drain passage 56. The blow-by gases, along with any water that has condensed on the interior walls of filter housing 40 or the exterior surfaces of collection container 44, may then be discharged to the atmosphere (or alternatively, back into power source 10 for subsequent combustion) by way of ports 50 and 52.

Several advantages may be associated with the disclosed ventilation system. For example, because portions of power system 10 exposed to the atmosphere may be thermally insulated, the likelihood of water condensation upstream of filtering medium 42 may be low. And, the likelihood of condensation may be lowered even further with the use of heating mechanism 60. In addition, because filtration canister 34 may include collection container 44, any water that does condense may be maintained separate from the oil and discharged to the atmosphere. By minimizing the contamination of oil inside crankcase 28, proper operation of power system 10 for longer periods of time may be ensured.

It will be apparent to those skilled in the art that various modifications and variations can be made to the disclosed ventilation system. Other embodiments will be apparent to those skilled in the art from consideration of the specification and practice of the disclosed ventilation system. It is intended that the specification and examples be considered as exemplary only, with a true scope being indicated by the following claims and their equivalents.

What is claimed is:

1. A ventilation system for use with an engine having a crankcase, comprising:

a breather housing connected to ventilate gases from the crankcase; and a filtration canister fluidly connected downstream of the breather housing and including:

a filter housing;

a filtering medium located within the filter housing to collect oil from the gases;

an oil collection container disposed within the filter housing and being configured to receive at least a portion of the filtering medium and having a drain port in fluid communication with the crankcase; and at least one port configured to discharge the gases from the housing after the gases have passed through the filtering medium.

2. The ventilation system of claim 1, wherein the oil collection container is open ended and has an internal annular surface spaced apart from an external annular surface of the filtering medium such that an annular clearance space is maintained therebetween.

3. The ventilation system of claim 1, wherein the oil collection container is integral with the filter housing.

4. The ventilation system of claim 1, wherein an external surface of the oil collection container is angled toward the at least one port to promote condensate draining.

5. The ventilation system of claim 1, wherein the at least one port includes:

a first discharge port located at a first end of the filter housing to promote condensate discharge to the atmosphere; and a second discharge port located at an opposing second end of the filter housing to promote gaseous discharge to the atmosphere.

6. The ventilation system of claim 5, wherein the first discharge port is restricted.

7. The ventilation system of claim 1, further including a passageway fluidly connecting the breather housing to the filter housing, wherein at least one of the breather housing, the filter housing, and the passageway are thermally insulated to maintain the temperature of the gases above a dew point temperature of the gases until after the gases have passed through the filtering medium.

8. The ventilation system of claim 7, wherein each of the breather housing, the filter housing, and the passageway are insulated.

9. The ventilation system of claim 7, wherein at least one of the breather housing and the filter housing are fabricated from a glass filled nylon material.

10. The ventilation system of claim 7, wherein the passageway directs the gases to a center of the filtering medium.

11. The ventilation system of claim 1, further including a heating mechanism configured to maintain a temperature of the gases above a dew point temperature of the gases until after the gases have passed through the filtering medium.

12. The ventilation system of claim 11, wherein the heating mechanism is located at an exit of the breather housing.

13. The ventilation system of claim 12, further including a breather filtration element located at an exit of the breather housing, wherein the heating mechanism is located downstream of the breather filtration element.

14. The ventilation system of claim 1, further including:

a drain passageway connecting the drain port with the crankcase; and a check valve located within the drain passageway.

15. A method of venting gases from an engine's crankcase, comprising:

directing the gases from the crankcase to a filtering location;

inhibiting water vapor within the gases from condensing before the gases reach the filtering location;

removing oil from the gases at the filtering location;

directing the removed oil back into the crankcase;

discharging water that condenses at the filtering location to the atmosphere; and discharging the gases to the atmosphere, and restricting the discharge of condensed water.

16. The method of claim 15, wherein the condensed water is discharged separate from the gases.

17. The method of claim 15, wherein inhibiting includes thermally insulating the gases from the atmosphere.

18. The method of claim 15, wherein inhibiting includes heating the gases.

19. A power system, comprising:

an engine block;

an oil pan connected to the engine block to form a crankcase;

an insulated cover connected to the engine block and configured to vent gasses from the crankcase;

an insulated filter housing connected to the receive the gases from the insulated valve cover by way of an insulated passage;

a filtering medium located within the insulated filter housing to collect oil from the gases;

an oil collection container configured to receive at least a portion of the filtering medium and having a drain port in fluid communication with the crankcase, wherein the oil collection container is open ended and has an internal annular surface spaced apart from an external annular surface of the filtering medium such that an annular clearance space is maintained therebetween;

a first discharge port located at a first end of the insulated filter housing to promote condensate discharge; and a second discharge port located at an opposing second end of the insulated filter housing to promote gaseous discharge.

* * * * *